US008379905B2

(12) United States Patent
He

(10) Patent No.: US 8,379,905 B2
(45) Date of Patent: Feb. 19, 2013

(54) MICRO-SPEAKER

(75) Inventor: Jing He, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 205 days.

(21) Appl. No.: 12/978,595

(22) Filed: Dec. 26, 2010

(65) Prior Publication Data

US 2011/0311093 A1 Dec. 22, 2011

(30) Foreign Application Priority Data

Jun. 21, 2010 (CN) ..... 2010 2 0231935 U

(51) Int. Cl.
*H04R 1/02* (2006.01)
*H04R 1/00* (2006.01)

(52) U.S. Cl. ..... 381/410; 381/386

(58) Field of Classification Search ..... 181/144, 181/165; 381/423, 424, 345, 333–335, 398, 381/400, 410; 455/575.1
See application file for complete search history.

(56) References Cited

U.S. PATENT DOCUMENTS

| | | | | |
|---|---|---|---|---|
| 3,573,396 | A * | 4/1971 | Schoengold | 381/433 |
| 6,496,590 | B2 * | 12/2002 | Proni | 381/423 |
| 7,113,813 | B2 * | 9/2006 | Shimokawatoko et al. | 455/575.3 |

* cited by examiner

*Primary Examiner* — Curtis Kuntz
*Assistant Examiner* — Sunita Joshi
(74) *Attorney, Agent, or Firm* — IPro, Inc.; Na Xu

(57) ABSTRACT

A micro-speaker includes a frame, a yoke received in the frame, a connecting plate received in the yoke, a magnet received in the yoke, a pole plate attached onto the magnet, a diaphragm attached to the frame, a voice coil positioned on the connecting plate and surrounding the magnet, and a case covering the diaphragm. The diaphragm includes a central area in a center thereof, a joint area at an outer periphery thereof, and a connecting area between the central area and the joint area. The connecting plate includes a central portion formed in a central thereof for connecting with the central area of the diaphragm, and an oblique wall obliquely connecting to the central portion. The voice coil is wrapped on the oblique wall.

13 Claims, 2 Drawing Sheets

MICRO-SPEAKER

BACKGROUND OF THE INVENTION

1. Field of the Invention

The present disclosure relates to the art of speakers and, particularly to a micro-speaker for converting electrical signals including audio information to audible sounds.

2. Description of Related Art

With the continuing development of audio and sound technology, micro-speaker have been widely used in electronic devices, such as cellular phones, PDAs (personal digital assistants), and so on.

A micro-speaker related to the present invention includes a case defining a sound hole, a frame attached to the case for forming a chamber, a magnetic circuit defining a magnetic gap, a diaphragm located in the chamber, and a voice coil attached to the bottom of the diaphragm. While electrified, the voice coil will be activated to vibrate by the electromagnetic Ampere Force and further drives the diaphragm to vibrate, which converts the electrical signals to sound waves. The voice coil and the diaphragm need sufficient space to vibrate for ensuring good acoustic performance. However, as the trend of the volume of the micro-speaker is smaller and smaller, space provided for the diaphragm to vibrate is accordingly reduced and limited.

Therefore, it is desirable to provide a micro-speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
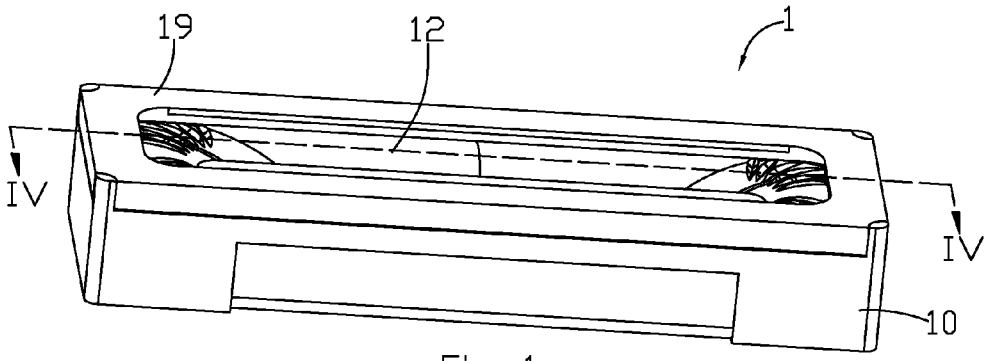
FIG. 1 is an assembly view of a micro-speaker according to an exemplary embodiment.
Figure 2:
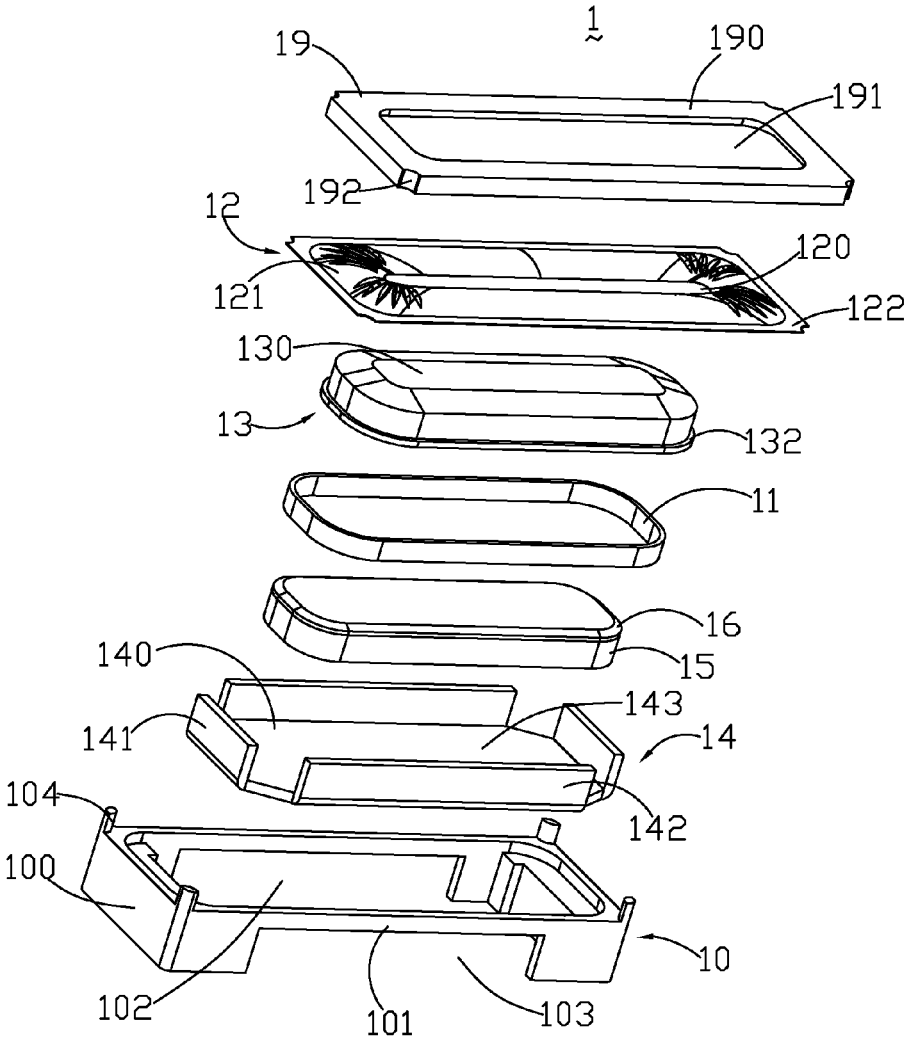
FIG. 2 is an exploded, isometric view of the micro-speaker of FIG. 1.
Figure 3:
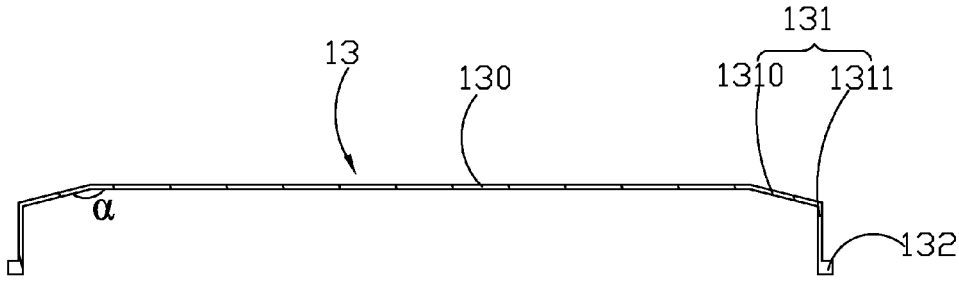
FIG. 3 is a side view of a connecting plate of the micro-speaker of FIG. 2.

Referring to FIGS. 1-2, a micro-speaker 1, according to an exemplary embodiment, includes a frame 10, a diaphragm 12 attached to the frame 10, a connecting plate 13 positioned below the bottom of the diaphragm 12, a yoke 14 engaged with the frame 10, a magnet 15 positioned on the yoke 14, a pole plate 16 positioned on the upper surface of the magnet 15, a voice coil 11 positioned on the connecting plate 13 and surrounding the magnet 15, and a case 19 covering a periphery of the diaphragm 12. The frame 10 cooperatively with the case 19 defines a chamber (not labeled) therebetween for receiving the voice coil 11, the diaphragm 12, the connecting plate 13, the yoke 14, the magnet 15, and the pole plate 16 therein. In the present embodiment, the voice coil 11, the diaphragm 12 and the connecting plate 13 cooperatively form a vibration system for producing sound via vibrating. The yoke 14, the magnet 15 and the pole plate 16 cooperatively form a magnetic system.

The frame 10 includes a pair of first longitudinal sidewalls 100, a pair of second transverse sidewalls 101, and a receiving room 102 formed between the first longitudinal sidewalls 100 and the first transverse sidewalls 101. The yoke 14 is received in the receiving room 102. The frame 10 further defines four semi-columned protrusions 104 extending upwardly and perpendicularly from the corresponding four corners thereof. The pair of first transverse sidewalls 101 each defines a slot 103 substantially spanning most height thereof and formed at the center thereof.

The yoke 14 includes a base wall 140, a pair of second longitudinal sidewalls 141 extending upwardly and perpendicularly from a longitudinal outer periphery of the base wall 140, and a pair of second transverse sidewalls 142 extending upwardly and perpendicularly from a transverse outer periphery of the base wall 140. The base wall 140 and the second sidewalls 141, 142 cooperatively define a receiving chamber 143 therebetween. Top ends of the second transverse sidewalls 142 of the yoke 14 are located below and restricted by the first transverse sidewalls 101. Another word, when assembled, the second transverse sidewalls 142 are positioned in the slots 103. Thus, the yoke 14 is positioned in the frame 10.

The magnet 15 is attached on the top of the base wall 140. The pole plate 16 is attached to a top surface of the magnet 15. The magnet 15 and the pole plate 16 are received in the receiving chamber 143 of the yoke 14, and are coaxial with the yoke 14. The shape and configuration of the magnet 15 is substantially same as the pole plate 16. An outer diameter of the magnet 15 and an outer diameter of the pole plate 16 are smaller than an inner diameter of the yoke 14. Thereby, outer peripheral side surfaces of the magnet 15 and the pole plate 16, and the second sidewalls 141, 142 of the yoke 14, cooperatively define an annular gap 17 (referring to FIG. 4) therebetween, for accommodating bottom ends of the voice coil 11 and the connecting plate 13 therein. The voice coil 11 surrounds the magnet 15 and the pole plate 16. The voice coil 11, together with the connecting plate 13, is movable upwardly and downwardly in the annular gap 17.

The diaphragm 12 includes a central area 120 in a center thereof, a joint area 122 at an outer periphery thereof, and a connecting area 121 between the central area 120 and the joint area 122. The central area 120, the joint area 122 and the connecting area 121 are coaxial with the connecting plate 13, the magnet 15 and the pole plate 16. The connecting area 121 is curved upwardly or downwardly to form an annular bugle or concave. In fact, the joint area 122 is the periphery covered by the case 19, as mentioned above.

Figure 4:
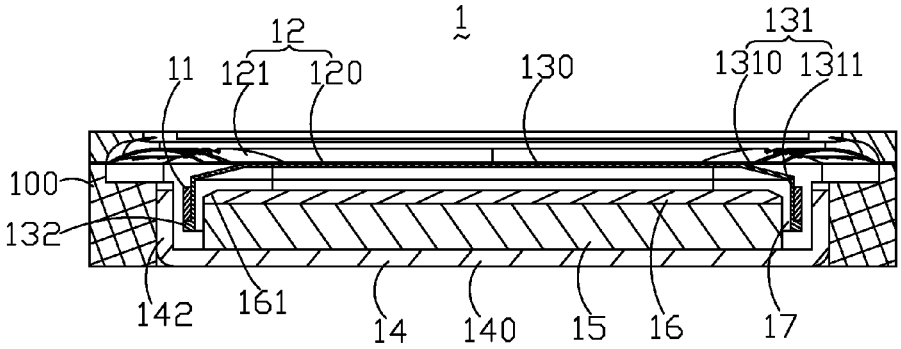
FIG. 4 is a schematic cross-sectional view of the micro-speaker taken along line IV-IV of FIG. 1.
Figure 5:
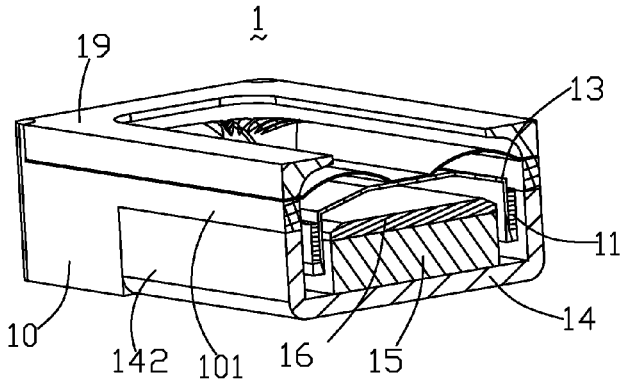
FIG. 5 is an isometric view of the micro-speaker of FIG. 1, part of the micro-speaker being cut away.

Referring to FIGS. 2, 3, 4, and 5, the connecting plate 13 includes a central portion 130, an oblique wall 131, and an annular base portion 132. The oblique wall 131 is obliquely connected between the central portion 130 and the base portion 132. An outer diameter of the base portion 132 is greater than an outer diameter of the central portion 130. The oblique wall 131 includes a first part 1310 obliquely connecting with the central portion 130, and a second part 1311 extending upwardly from the base portion 132. The central portion 130 is connected with the bottom surface of the central area 120 of the diaphragm 12 for supporting the diaphragm 12. The voice coil 11 is wrapped on the second part 1311 and positioned on the base portion 132. In the present embodiment, an obtuse angle $\alpha$ is formed between the central portion 130 and the first part 1310, and the second part 1311 is extending upwardly and perpendicularly from the base portion 132. Alternatively, in other embodiments, there can form an acute angle between the central portion 130 and the first part 1310, and the second part 1311 is non-perpendicular to the base portion 132. The base portion 132 is used to carry the voice coil 11 for securing the voice coil with the connecting plate 13. It is to be understood that the base portion 132 can be also omitted. Without the base portion 132, the voice coil 11 can be wound directly around the second part 1311. In a word, the connecting plate includes a central portion, an oblique wall extending downwardly from the central portion and forming an angle not equal to 90 degrees. Referring to FIG. 4, corresponding to the oblique sidewall 131, the pole plate 16 further defines a bevel 161 for providing more vibrating space to the connecting plate 13.

The case 19 attaches onto the frame 10 to cover the joint area 122 of the diaphragm 12. The case 19 includes a base 190, and a sound outlet 191 formed in the center of the base 190. The base 190 defines four semi-columned recesses 192 at the four corners thereof to engage with the corresponding protrusions 104 of the frame 10, thereby the mechanical connection between the frame 10 and the case 19 is obtained and secured. Sound generated by the micro-speaker 1 is transmitted to the outside of the micro-speaker 1 through the sound outlet 191.

When an electric current is applied to the voice coil 11, a magnetic field loop is produced in the vibrating system and the magnetic system. Thus, the voice coil 11 is activated to move by the electromagnetic Ampere force, and accordingly, the connecting plate 13 and the diaphragm 12 are driven to vibrate by the voice coil 11, which produces sound waves.

It is to be understood, according to the Right-Hand Rule: the electromagnetic force F applied to voice coil 11 can be calculated by the formula: F=BIL, wherein B is the magnetic flux passing through the voice coil 11 in the magnetic field generated by the voice coil 11 and the yoke 14, the magnet 15 and the pole plate 16; I is the current flowing through the voice coil 11; L is the effective length of the voice coil 11 in the magnetic field. In the present micro-speaker 1, the voice coil 11 is wrapped on the second part 1311 of the connecting plate 13, the first part 1310 is oblique to the central portion 130, and the central portion 130 is connected with the bottom of the central portion 120 of the diaphragm 12. With the above-mentioned configuration, the length L of the voice coil 11 is increased compared with the conventional micro-speaker with the voice coil directly attached to the bottom of the diaphragm. Specifically, the magnetic force F is varied related to the current I, the magnetic flux B and the length L, when the current I and the magnetic field B are invariable, the force F of the voice coil 11 in the magnetic field is increased based on the increasing length L. Meanwhile, when the force F is increased enough, the low frequency bandwidth of the sound of the micro-speaker is expanded, thereby the sound output quality of the micro-speaker 1 is improved.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro-speaker comprising:

a frame;

a case supported on the frame and cooperatively with the frame defining a chamber therebetween;

a diaphragm received in the chamber and attached to the frame;

a yoke received in the chamber;

a magnet received in the chamber and attached on the top of the yoke;

a pole plate received in the chamber and attached to the top of the magnet;

a connecting plate received in the chamber and defining a central portion attached to the bottom of the diaphragm, and an oblique sidewall obliquely connecting to the central portion;

a voice coil wrapped round the oblique sidewall of the connecting plate and surrounding the magnet and the pole plate; and wherein the oblique sidewall defines a first part obliquely connecting to the central portion, and a second part connecting with the first part and extending downwardly perpendicular to the central portion, the voice coil is wrapped round the second part of the oblique sidewall, and together with the second part moves up and down in a magnet gap formed between the magnet and the inner wall of the yoke when an electric current applied to the voice coil.

2. The micro-speaker as claimed in claim 1, wherein an obtuse angle is formed between the first part and the central portion.

3. The micro-speaker as claimed in claim 1, wherein an acute angle is formed between the first part and the central portion.

4. The micro-speaker as claimed in claim 1, wherein the connecting plate further includes an annular base portion extending perpendicularly from the second part for carrying a bottom end of the voice coil, and an outer diameter of the base portion is greater than an outer diameter of the central portion.

5. The micro-speaker as claimed in claim 1, wherein the diaphragm includes a central area formed on a center thereof and connected with the central portion of the connecting plate, a joint area at an outer periphery thereof, and a connecting area between the central area and the joint area, the central area, the joint area and the connecting area are coaxial.

6. The micro-speaker as claimed in claim 5, wherein the connecting area is curved upwardly or downwardly to form an annular bugle or a concave, and the joint area is annular and disposed at an outer periphery of the connecting area.

7. The micro-speaker as claimed in claim 1, wherein the frame includes a pair of first longitudinal sidewalls, a pair of first transverse sidewalls, and the yoke includes a base wall, a pair of second longitudinal sidewalls extending upwardly and perpendicularly from a longitudinal outer periphery of the base wall, and a pair of second transverse sidewalls extending upwardly and perpendicularly from a transverse outer periphery of the base wall, the second transverse wall defines a slot for accommodating the first transverse sidewall.

8. The micro-speaker as claimed in claim 1, wherein the frame further includes a plurality of semi-columned protrusions extending upwardly from the a plurality of corresponding corners thereof, and the case further includes a plurality of semi-columned recesses for engaging with the corresponding protrusions of the frame.

9. The micro-speaker as claimed in claim 1, wherein the pole plate includes a bevel corresponding to the oblique sidewall of the connecting plate.

10. A micro-speaker comprising:

a frame;

a case supported on the frame and cooperatively with the frame defining a chamber therebetween;

a diaphragm received in the chamber and attached to the frame;

a yoke received in the chamber;

a magnet received in the chamber and attached on the top of the yoke;

a pole plate received in the chamber and attached to the top of the magnet;

a magnetic gap formed between the magnet and the yoke;

a connecting plate received in the chamber and defining a central portion attached to the bottom of the diaphragm, and an oblique sidewall obliquely connecting to the central portion and partially received in the magnetic gap;

a voice coil wrapped round the oblique sidewall of the connecting plate;

wherein the oblique sidewall defines a first part obliquely connecting to the central portion, and a second part connecting with the first part and received in the magnetic gap, the voice coil is wrapped round the second part of the oblique sidewall, and together with the second part moves up and down in the magnetic gap when an electric current applied to the voice coil.

11. The micro-speaker as described in claim 10, wherein the connecting plate further includes an annular base portion extending perpendicularly from an end of the second part for carrying a bottom end of the voice coil.

12. The micro-speaker as described in claim 10, wherein the magnetic circuit includes a magnet and a pole plate on a top of the magnet, the pole palate includes a bevel corresponding to the oblique sidewall of the connecting plate.

13. A micro-speaker comprising:

a frame;

a case supported on the frame and cooperatively with the frame defining a chamber therebetween;

a diaphragm received in the chamber and attached to the frame;

a magnetic circuit including a magnetic gap;

an integrated connecting plate received in the chamber and defining a central portion attached to the bottom of the diaphragm, and an oblique sidewall obliquely extending from the central portion;

a voice coil wrapped round the oblique sidewall of the connecting plate;

wherein the oblique sidewall defines a first part obliquely extending from the central portion, and a second part connecting with the first part and at least partially received in the magnetic gap, the voice coil is wrapped round the second part of the oblique sidewall, and together with the second part moves up and down in the magnetic gap when an electric current applied to the voice coil.

* * * * *